US010870061B2

(12) United States Patent
Ozturk

(10) Patent No.: US 10,870,061 B2
(45) Date of Patent: Dec. 22, 2020

(54) WATERSLIDE SYSTEM

(71) Applicant: POLIN SU PARKLARI VE HAVUZ SISTEMLERI ANONIM SIRKETI, Kocaeli (TR)

(72) Inventor: Ali Sinan Ozturk, Kocaeli (TR)

(73) Assignee: POLIN SU PARKLARI VE HAVUZ SISTEMLERI ANONIM SINKETI, Kocaeli (TR)

( * ) Notice: Subject to any disclaimer, the term of this patent is extended or adjusted under 35 U.S.C. 154(b) by 85 days.

(21) Appl. No.: 16/095,697

(22) PCT Filed: Jul. 11, 2016

(86) PCT No.: PCT/TR2016/050222
§ 371 (c)(1),
(2) Date: Oct. 23, 2018

(87) PCT Pub. No.: WO2018/013063
PCT Pub. Date: Jan. 18, 2018

(65) Prior Publication Data
US 2020/0215441 A1 Jul. 9, 2020

(51) Int. Cl.
*A63G 21/18* (2006.01)

(52) U.S. Cl.
CPC ..... *A63G 21/18* (2013.01)

(58) Field of Classification Search
CPC ..... A63G 21/00; A63G 21/02; A63G 21/10; A63G 21/14; A63G 21/16; A63G 21/18; A63G 31/007; A63B 69/0093; A63B 2009/006; A63B 2009/008
USPC ..... 472/116–117, 128, 129, 13; 104/69, 70
See application file for complete search history.

(56) References Cited

U.S. PATENT DOCUMENTS

| | | | | |
|---|---|---|---|---|
| 5,137,497 | A | 8/1992 | Dubeta | |
| 8,608,581 | B2 | 12/2013 | Hunter | |
| 2002/0077180 | A1* | 6/2002 | Swanberg | A63F 13/10 463/43 |
| 2002/0142851 | A1 | 10/2002 | Hunter | |
| 2004/0198520 | A1 | 10/2004 | Hlynka | |
| 2009/0062025 | A1* | 3/2009 | Hlynka | A63G 21/18 472/117 |
| 2012/0122598 | A1* | 5/2012 | spiroglu | A63G 21/18 472/117 |
| 2012/0190465 | A1 | 7/2012 | Hunter | |

FOREIGN PATENT DOCUMENTS

| | | | |
|---|---|---|---|
| CN | 204543533 | U | 8/2015 |
| WO | 2011057395 | A1 | 5/2011 |

* cited by examiner

*Primary Examiner* — Kien T Nguyen
(74) *Attorney, Agent, or Firm* — Bayramoglu Law Offices LLC

(57) ABSTRACT

According to the waterslide system of the present invention, a rider enters to a spiral path at a entry gradient of a starting gradient, moves against the gravity at a 360° rotational axis and leaves from an exit gradient of a starting gradient by accelerating opposite direction of the entry speed from a peak point.

10 Claims, 2 Drawing Sheets

Fig. 1
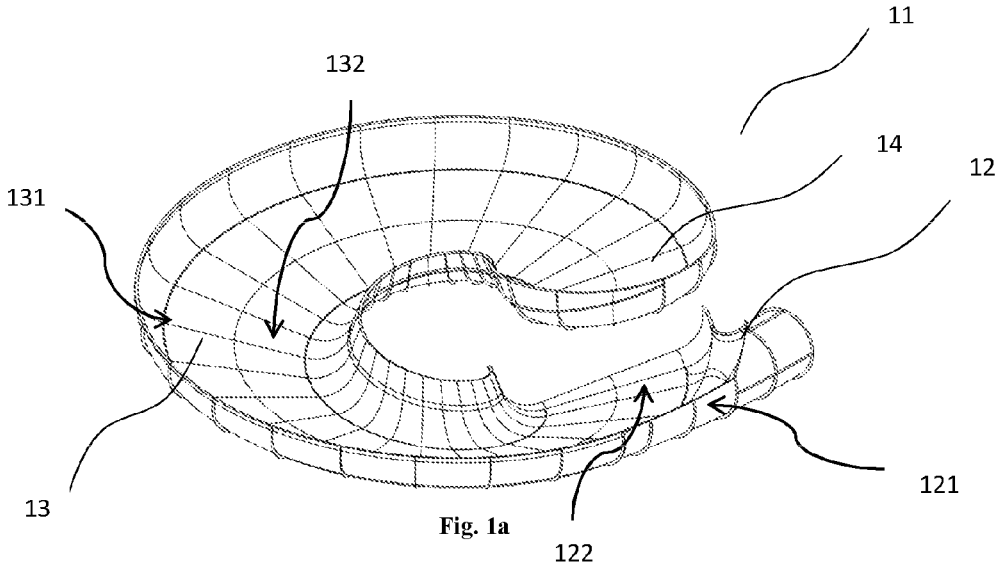
Fig. 1a
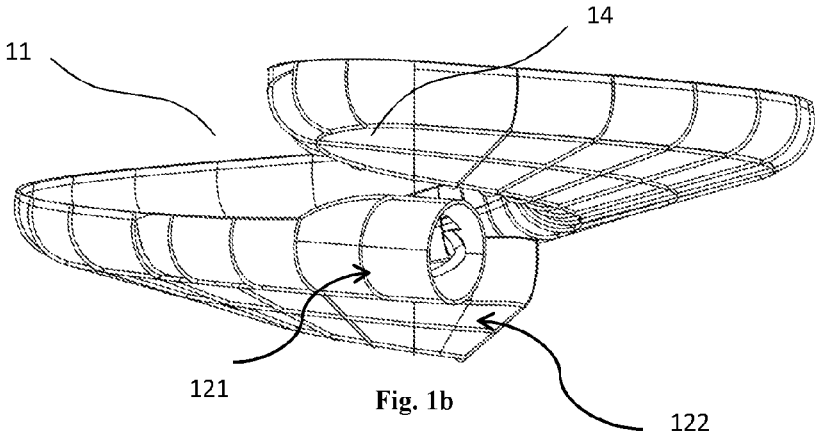
Fig. 1b
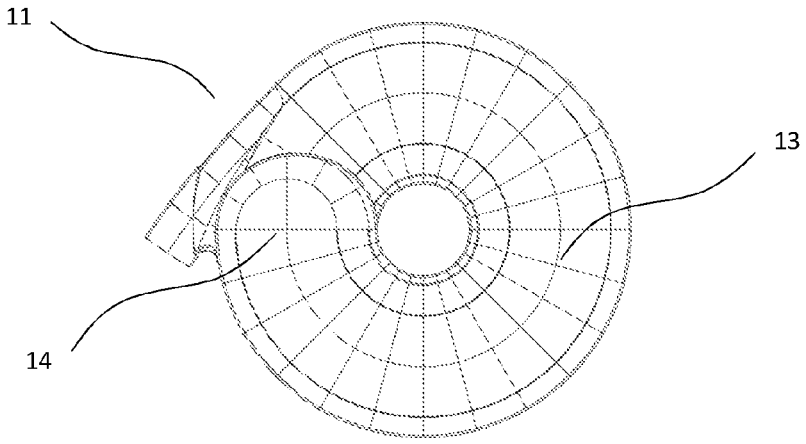
Fig. 1c

Fig. 2
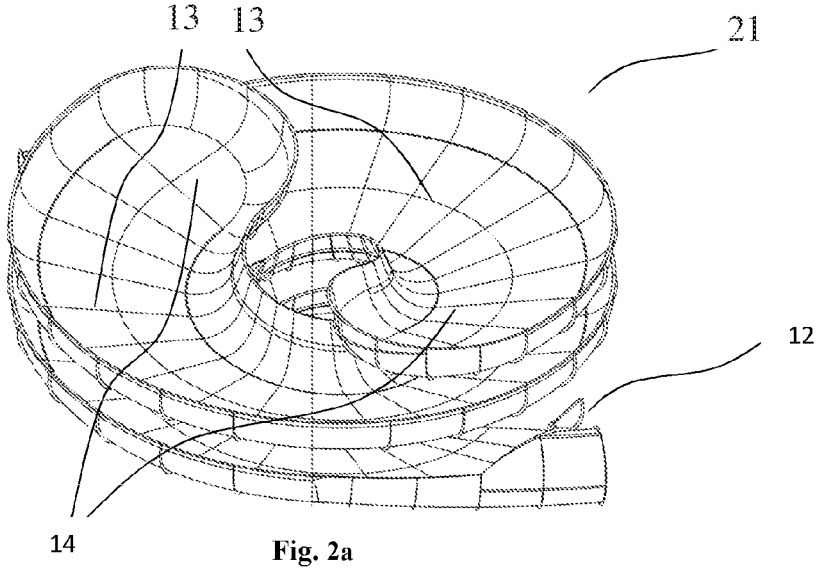
Fig. 2a
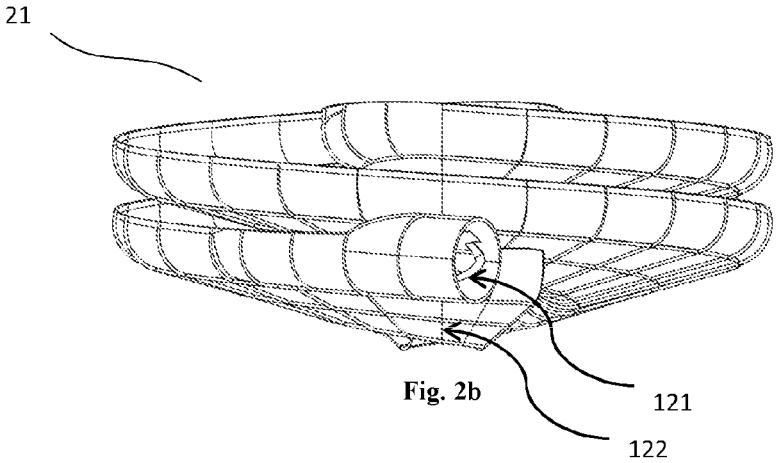
Fig. 2b
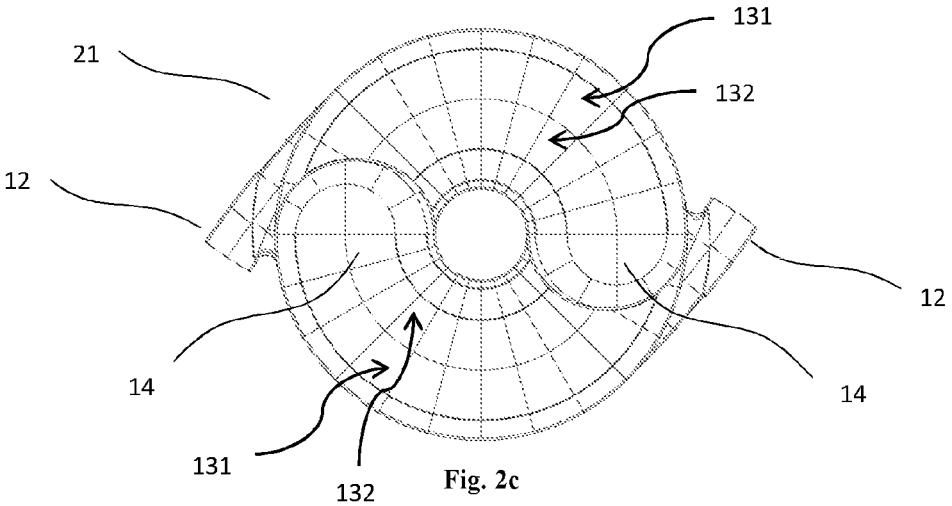
Fig. 2c

WATERSLIDE SYSTEM

CROSS REFERENCE TO RELATED APPLICATIONS

This application is the national phase entry of International Application No. PCT/TR2016/050222, filed on Jul. 11, 2016, the entire contents of which are incorporated herein by reference.

TECHNICAL FIELD

Invention relates to a waterslide allowing operation with or without use of water for utilization of the persons at the amusement parks.

Invention particularly relates to system of a waterslide with enhanced functionality aiming to provide more entertainment by rider's helical movement against the gravity at a single lane.

BACKGROUND

Slides at the playgrounds are produced in special dimensions to fit children's use. Developing technology and inspiration allowed construction of larger slides for both adult and children use. Later on, the large slides are moved from sandy playgrounds to the amusement parks with pools. Subsequently, slide for amusement and sports combined with swimming provided by falling riders on the slide to a pool.

Expectations from the activities at the amusement parks are increasing. Therefore, slides providing various sliding movements are developed.

WO2011057395 A1 patent document discloses a water slide feature comprising a sliding surface curved concave relative to all three axes (X, Y and Z axes) sized and adapted to carry one or more riders and/or ride vehicles sliding thereon on a non-predetermined path, an entry sized and positioned to direct the one or more riders and/or ride vehicles along the sliding surface on a path which is at least partially upward. However, the water slide system has not movement capability against at the 360-degree rotational axis.

Patent document U.S. Pat. No. 8,608,581 B2 discloses a slider comprising a funnel shaped sliding surface. The funnel shaped sliding surface comprising a top and a bottom wall. Position of the walls against each other force rider to a movement at a slider entrance axis at an opposite angle of 90 degrees to the gravity. However, said slider cause rider to slide at a limited sliding surface so that the speed decreases to zero and move at the gravity direction. Rider move only in one axis against the gravity.

US 20040198520 A1 patent document discloses a waterslide comprising two flat surface path parts disposed at a narrow angle and connected at an intersection. End of a first flat elongated path, starting from the entry path, extends inside a second flat elongated path transformed into an exit path at the end of the slide activity. The path flow of the rider is follow a zigzag course. After rider leaving the entry path slide movement follow an uphill direction.

Following to the first path flow slide movement decrease as low as zero so that rider is subjected to a new speeding phase at the opposite sliding direction. This system allow rider to move only in one direction.

Known slide systems at the water parks provide different movement axis for the rider but limits the movement to only one direction.

Consequently, disadvantages of the known applications entail a development in the related technical field.

SUMMARY

Starting from the prior art object of the invention is providing a waterslide system having a movement capability against gravity at the 360° horizontal rotational axis, covering a spiral path below the highest speeding forces allowed by the industry standards.

Another object of the invention is providing a waterslide system covering 360° surrounding angle from the start of the spiral path and inclined 5° to 85° between two edges of the spiral path.

Another object of the invention is reducing the speed of a rider during the transfer to the uphill path section at the speed level of the upper limits defined by the industry standards for waterslides at the start of spiral path in order to prevent body exposure to loads induced by speed and centrifugal speeds.

Another object of the invention is providing a waterslide system with changing centrifugal forces by converting kinetic energy to potential energy by reduction of the kinetic energy to the zero at the peak point of the path and provide a configuration to gain speed at an opposite direction to move horizontally at 360° rotation axis.

Another object of the invention is obtaining a waterslide system having a spiral path which can be adapted to the entry, exit or intermediate position of the two different type of the slides.

Another object of the invention is providing a waterslide system transferring rider to another exit without leaving the one where rider enter into the spiral path by after speeding at the spiral path turning back to the starting point from the peak and speed up again at an opposite direction to the entry into the spiral path again moving to the same sliding path.

Another object of the invention is providing a waterslide system preventing extreme speeds which may lead to injuries by means of limiting the height between the peak of the spiral path and starting point to 10000 mm and/or increase the number of spiral path.

BRIEF DESCRIPTION OF THE DRAWINGS

Drawings of a waterslide system embodied to achieve objective of the invention are shown.

FIG. 1*a*. Perspective view of a first application of a waterslide system.

FIG. 1*b*. Side view of a first application of a waterslide system.

FIG. 1*c*. Top view of a first application of a waterslide system.

FIG. 2*a*. Perspective view of an alternative application of a waterslide system.

FIG. 2*b*. Side view of an alternative application of a waterslide system.

FIG. 2*c*. Top view of an alternative application of a waterslide system.

REFERENCE NUMBERS

11. Waterslide system
12. Starting gradient
  121. Entry gradient
  122. Exit gradient
13. Spiral Path
  131. Primary path section

132. Secondary path section
14. Peak point
21. Waterslide system

DETAILED DESCRIPTION

A waterslide system (11, 21) according to the subject matter is basically;

at least one starting gradient (12) providing entry of the rider to the waterslide system (11, 21) at a speed under predetermined maximum force threshold and exit after completion of the movement at 360° rotational axis, a spiral path (13) configured so that providing entry of the rider to the waterslide system (11, 21) at a speed under predetermined maximum force threshold and exit after completion of the movement at 360° rotation axis, at least one peak point (14) configured such that riders speed is decreased to zero after completion of the movement through the against the gravity at 360° rotation axis and speed up at the opposite direction by 180° rotational movement.

Waterslide system (11) application as shown in FIG. 1, a rider enters from the entry gradient (121) of the starting gradient (12) at a speed below the maximum speeding forces allowed under the industry standards for waterslides, move through primary path section (131) extending along the longer edge of the path (13) against the gravity, along a peak point (14) at the 360° rotational axis parallel to the ground. Rider speed decreases from the entry speed with decreasing acceleration and reach close to zero at the peak point (14).

Primary path section (131) and secondary path section (132) which are components of the spiral path (13) and presented along the long and short edges, are at an angle of inclination 5° to 85° to the ground. Said inclination allow rider to reach the peak point (14) without exceeding the speed limits and converts kinetic energy to the potential energy to decrease the speed close to zero. Additionally, the same inclination provides 180° back movement of the rider from the peak point (14) to gain an opposite speed to the exit direction on the spiral path (13) reaching the exit gradient (122) at the starting gradient (12) by moving along the secondary path section (132) at the shorter edge.

The inclination between the primary and secondary path section (131, 132) allow rider to start moving again from the entry gradient (121) of the starting gradient (12) and again complete the sliding movement at the exit gradient (122) of the starting gradient (12). Therefore, rider's movement against gravity and downhill movement from the peak point (14) is arranged at the only one lane and the same spiral path (13).

Spiral path (13) is collected by primary and secondary path section (131, 132) mounted to each other by means of the removable flange connectors. Sliding surface of the spiral path (13) is wet by a water or sprayed water to decrease frictional forces and provide sliding movement to reduce frictional resistance.

At the peak point (14) while the rider transferred from primary path section (131) to the secondary path section (132) less centrifugal moment is affected than the short time load limits. This provide opposite speeding against the entry direction due to the potential energy at the peak point (14) an adventure feeling at the rider without any harming effect on the body.

Primary or secondary path sections (131, 132) preferably made of transparent, semi-transparent or opaque fiber, carbon or glass fiber reinforced polymeric matrix composite materials. Alternatively, plastic pipes can be made of transparent plastics like PMMA and PC.

Spiral path (13) of the inventive waterslide system (11) cover at least 2700 peripheral angle between the starting gradient (12) and peak point (14). Sliding surface of the spiral path (13) is disposed at a parallel position to the ground (FIG. 1*c*).

A preferred embodiment of the invention the spiral path (12) is designed as a chute. Spiral path (13) of the waterslide system (11) according to the invention can be made of a closed tube or conical, elliptical, etc. other forms without sharp edges, open or closed geometry.

A preferred embodiment of primary path section (131) and secondary path section (132) components of the spiral path (13) is designed in U form. Those parts forming the spiral path can be mounted to the spiral path later in a condition of having inclined 5° to 85° to the ground. Part can be formed at any rounded form not allowing sharp edges.

Alternative application of the invention is a waterslide system (21) as shown in FIG. 2 comprises multiple spiral paths (13) arranged one inside the other so that more than one rider can use the system. This allow a competition among the riders.

Alternative waterslide system (21) comprises multiple spiral path (13) and same number of starting gradient (12) and peak point (14). Spiral path (13) can be designed to allow multiple tour around the 360° rotation axis.

Waterslide system (21) has mirror image each two starting gradients (12) and the peak point (14). Riders slide in a flow from starting gradients (12) to peak points (14) and again from peak points (14) to the starting gradients (12).

According to the subject matter waterslide systems (11, 21) between each one of the starting gradient (12) and peak point (14) there is a 1000 m to 5000 m height. Such a height is allowing a speed below the highest speeding forces to prevent body harm due to the movement at the speed.

In the inventive waterslide system (11, 21) in an alternative embodiment, the entry gradient (121) at the starting gradient (12) can be mounted to another slider so that a rider can access to the waterslide system (11, 21) by means of another slide or directly access to the waterslide system (11, 21).

In the inventive waterslide system (11, 21) in an alternative embodiment, exit gradient (122) at the starting gradient (12) can be mounted to another slider so that slide action of the rider can be guided to different slide systems or directly lead rider to a waterless exit or a pool.

The primary and the secondary path sections (131, 132) produced at the different molds can be produced by the same molds. In an alternative embodiment to the waterslide system (11, 21) rider can travel directly or by means of a boat, mat or other vehicles.

What is claimed is:

1. A waterslide system for amusement purposes and providing rider's helical movement, comprising:

at least one starting gradient providing entry of a rider to the waterslide system at a speed under a predetermined threshold force and exit after completion of a movement along a 360° rotational axis, a spiral path configured for providing entry of the rider to the waterslide system at a speed under a predetermined maximum threshold force and exit after completion of the movement along the 360° rotational axis, at least one peak point configured for decreasing a rider's speed to zero after completion of a movement against the gravity along the 360° rotational axis and speed up at the opposite direction by a 180° rotational movement.

2. The waterslide system according to claim 1, wherein each starting gradient has a peak point at a vertical height between 1000 mm to 5000 mm.

3. The waterslide system according to claim 1, wherein the waterslide system allows the rider to enter at the speed under the predetermined maximum speeding threshold force to the spiral path from an entry gradient at the at least one starting gradient.

4. The waterslide system according to claim 1, wherein the waterslide system allows the rider to enter the waterslide system from an entry gradient and exits from an exit gradient using a same path after completion of the movement along the 360° rotational axis.

5. The waterslide system according to claim 1, wherein the spiral path is configured for the rider to complete the movement against the gravity and a downhill movement from the peak point.

6. The waterslide system according to claim 1, wherein a primary path section is a component of the spiral path, and the primary path section allows the rider to move along the 360° rotational axis against the gravity at a longer edge of the spiral path.

7. The waterslide system according to claim 6, wherein a secondary path section is a component of the spiral path, and the secondary path section allows rider's movement from the peak point speed up and move again across an exit gradient and is disposed at a shorter edge of the spiral path.

8. The waterslide system according to claim 7, wherein the primary path section and the secondary path section have an inclination angle between 5° to 85° with the ground.

9. The waterslide system according to claim 8, wherein two spiral paths are configured for rider to move between the starting gradient to the peak point and back from the peak point to the starting gradient flowing with a mirror image symmetrical flow.

10. The waterslide system according to claim 1, wherein the waterslide system further comprises at least one additional spiral path, and at least two mirror images interposed between the starting gradient and the peak point.

* * * * *